US009779904B2

(12) United States Patent
Ishikawa et al.

(10) Patent No.: US 9,779,904 B2
(45) Date of Patent: Oct. 3, 2017

(54) CHIP TYPE FUSE

(71) Applicant: KOA CORPORATION, Ina-shi, Nagano (JP)

(72) Inventors: Takahiro Ishikawa, Ina (JP); Hiroshi Ichikawa, Ina (JP); Chika Ito, Ina (JP)

(73) Assignee: KOA CORPORATION, Ina-shi, Nagano (JP)

( * ) Notice: Subject to any disclaimer, the term of this patent is extended or adjusted under 35 U.S.C. 154(b) by 0 days.

(21) Appl. No.: 14/739,119

(22) Filed: Jun. 15, 2015

(65) Prior Publication Data

US 2015/0371804 A1 Dec. 24, 2015

(30) Foreign Application Priority Data

Jun. 19, 2014 (JP) ..... 2014-126036

(51) Int. Cl.

| | |
|---|---|
| ***H01H 85/04*** | (2006.01) |
| ***H01H 85/20*** | (2006.01) |
| ***H01H 85/06*** | (2006.01) |
| ***H01H 85/046*** | (2006.01) |
| *H01H 69/02* | (2006.01) |

(Continued)

(52) U.S. Cl.

CPC ..... *H01H 85/06* (2013.01); *H01H 85/046* (2013.01); *H01H 69/022* (2013.01); *H01H 85/185* (2013.01); *H01H 2085/0414* (2013.01)

(58) Field of Classification Search

CPC .... H01H 85/046; H01H 85/06; H01H 69/022; H01H 2085/0414; H01H 85/185

USPC ..... 337/159, 160, 186, 296

See application file for complete search history.

(56) References Cited

U.S. PATENT DOCUMENTS 2,911,504 A * 11/1959 Cohn ..... H01G 9/0003 337/159

4,140,988 A * 2/1979 Oakes ..... H01H 85/42 337/279

(Continued)

FOREIGN PATENT DOCUMENTS

CN WO 2013166788 A1 * 11/2013 ..... H01H 85/0411

JP 04065046 A * 3/1992 ..... H01H 85/046

(Continued)

OTHER PUBLICATIONS

JP 2008-52989, Mar. 2008, English machine translation.*

*Primary Examiner* — Anatoly Vortman

(74) *Attorney, Agent, or Firm* — Westerman, Hattori, Daniels & Adrian, LLP

(57) ABSTRACT

A chip type fuse excellent in resistance to climate conditions, where the fuse is able to operate stably under high temperature and high humidity environments. The fuse includes an insulative substrate; an under-glass layer formed on the insulative substrate; a fuse element formed on the under-glass layer; a pair of electrodes formed at both end sides of the fuse element; and an over-glass layer covering at least a fusing section of the fuse element; wherein the fuse element includes a layer where a first metal layer and a second metal layer are piled up, and a barrier layer consisting of a third metal layer, which covers the first metal layer and the second metal layer with a width that is wider than the width of the first metal layer and the second metal layer. The third metal layer overwraps the second metal layer and the first metal layer.

3 Claims, 4 Drawing Sheets

(51) Int. Cl.
*H01H 85/18* (2006.01)
*H01H 85/041* (2006.01)

(56) References Cited

U.S. PATENT DOCUMENTS 4,246,563 A * 1/1981 Noerholm ..... H01H 85/046 337/159
4,315,235 A * 2/1982 Jacobs, Jr. ..... H01H 85/08 337/161
4,320,374 A * 3/1982 Narancic ..... H01H 85/06 337/162
5,166,656 A * 11/1992 Badihi ..... H01C 17/006 337/227
5,432,378 A * 7/1995 Whitney ..... H01H 85/046 257/529
5,546,066 A * 8/1996 Kondo ..... H01H 85/11 29/623
5,572,181 A * 11/1996 Kiryu ..... H01H 85/18 337/273
5,668,522 A * 9/1997 Kondo ..... H01H 85/0417 337/160
5,914,649 A * 6/1999 Isono ..... H01H 85/0411 337/290
5,929,741 A * 7/1999 Nishimura ..... H01H 85/0411 337/159
6,034,589 A * 3/2000 Montgomery ..... H01H 85/0411 29/623
6,384,708 B1 * 5/2002 Jollenbeck ..... H01H 85/0411 337/290
6,452,475 B1 * 9/2002 Kawazu ..... H01H 85/463 29/623
6,566,995 B2 * 5/2003 Furuuchi ..... H01L 23/5256 257/E23.149
6,622,375 B1 * 9/2003 Endo ..... H01H 69/02 29/623
6,838,971 B2 * 1/2005 Senda ..... H01H 37/761 29/623
7,116,208 B2 * 10/2006 Nishimura ..... H01H 85/046 337/296
7,570,148 B2 * 8/2009 Parker ..... H01H 85/046 337/227
8,081,057 B2 * 12/2011 Chiu ..... H01H 69/02 29/623
8,957,755 B2 * 2/2015 Lu ..... H01H 85/046 337/292
9,035,740 B2 * 5/2015 Washizaki ..... H01H 69/022 29/623
2004/0169578 A1 * 9/2004 Jollenbeck ..... H01H 85/046 337/227
2008/0191832 A1 * 8/2008 Tsai ..... H01H 69/022 337/297
2011/0163840 A1 * 7/2011 Lu ..... H01H 69/022 337/296

FOREIGN PATENT DOCUMENTS

JP 2008-052989 A 3/2008
WO WO 2013059604 A1 * 4/2013 ..... H01H 69/02

* cited by examiner

[FIG. 1]
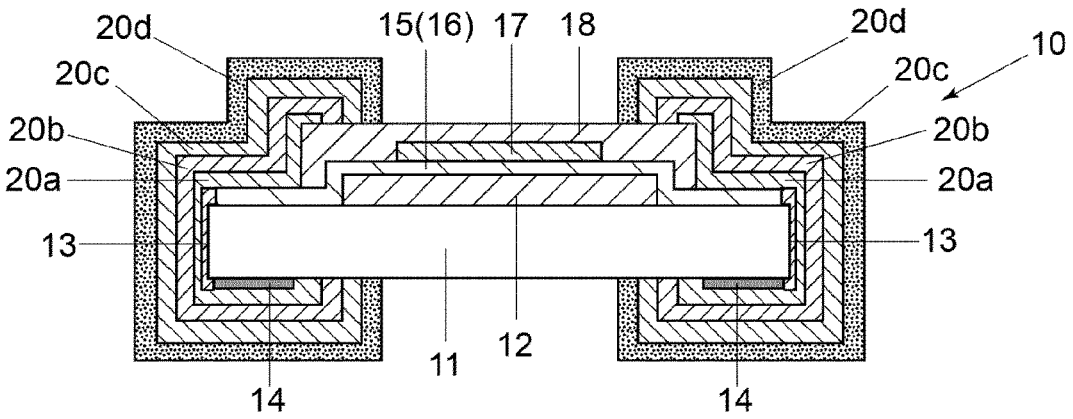
[FIG. 2]
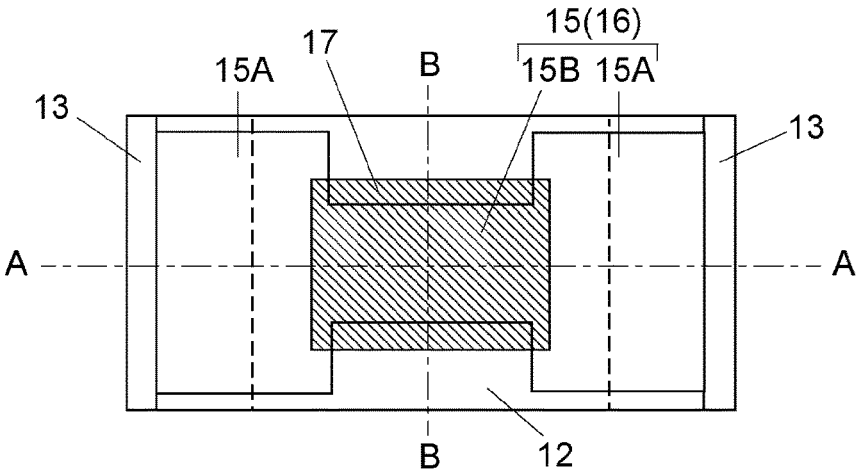

[FIG. 3]
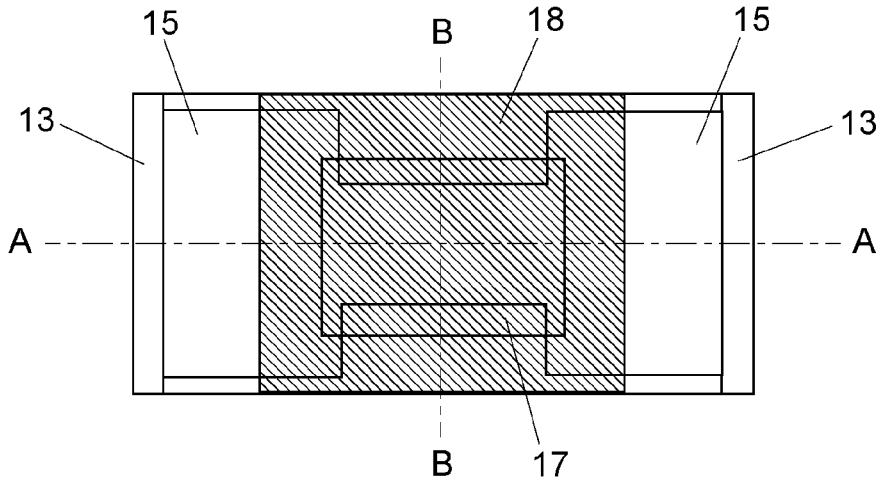
[FIG. 4]
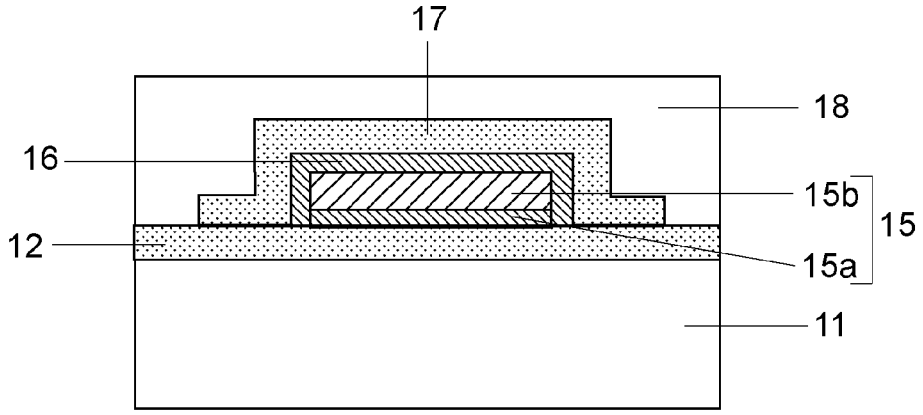

[FIG. 5]
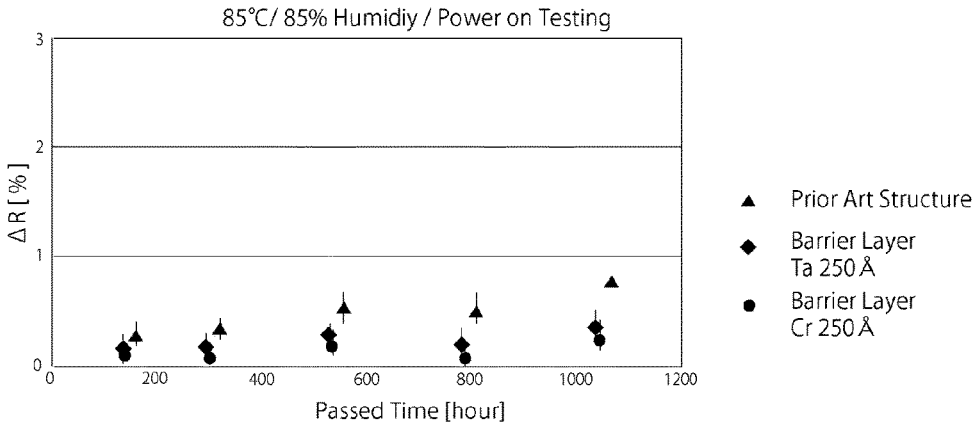
[FIG. 6]
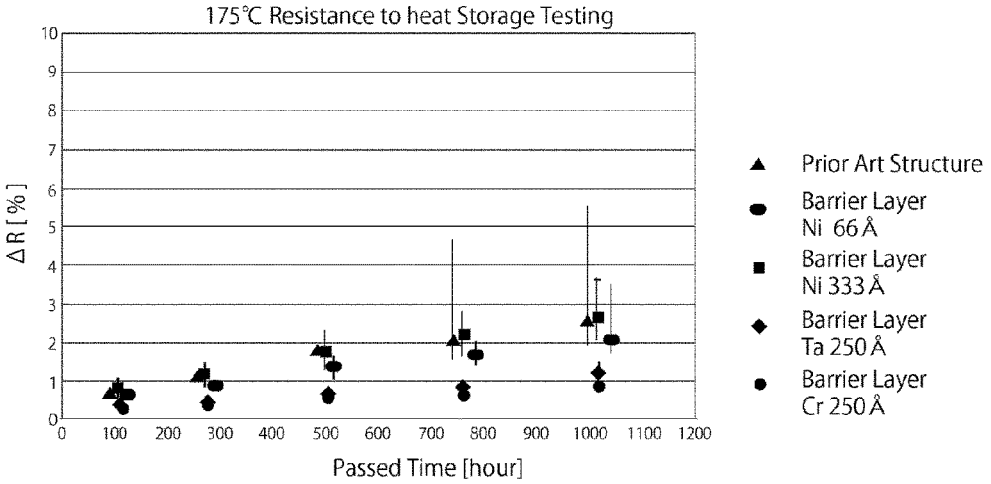

[FIG. 7]
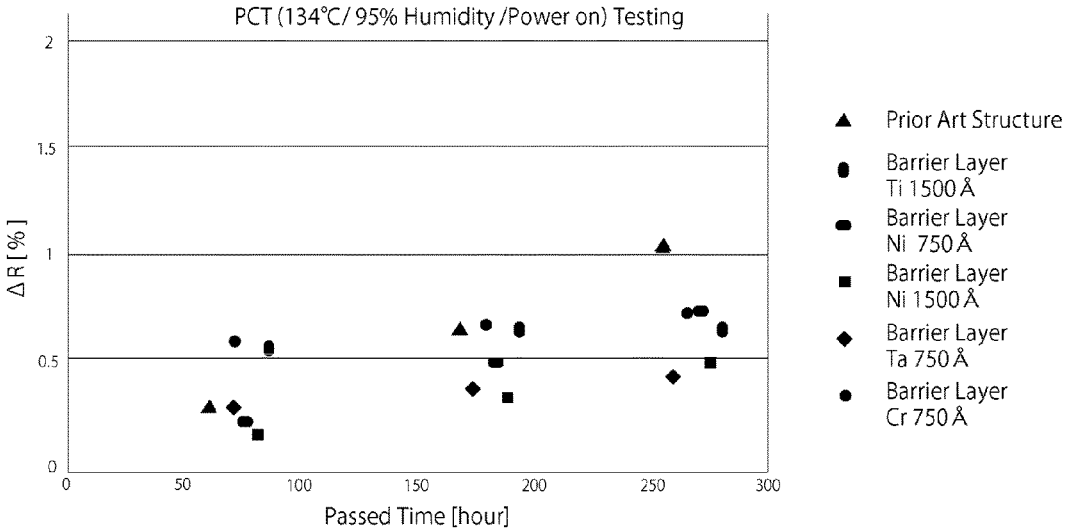

CHIP TYPE FUSE

TECHNICAL FIELD

The invention relates to circuit protection elements, particularly chip type fuses having a fuse element, which fuses by a prescribed overcurrent.

BACKGROUND ART

The chip type fuse has previously been known (for example, see laid-open Japanese patent publication 2008-52989). The chip type fuse includes an under-glass layer formed on an upper surface of an insulative substrate, a pair of thick film electrodes formed on the glass layer, a fuse element of thin film or thick film formed so as to connect to the thick film electrodes, an over-glass layer formed on the fuse element, and a resin protective layer formed on an upper surface of the glass layer.

Within such a chip type fuse, because the fuse element is covered by under and over glass layers, an effect that heat from the fuse element is stored therein is caused, and the fuse element can be fused with a small overcurrent at high speed.

In the chip type fuse, the fuse element is covered by the glass layers on both sides for improving fusing characteristics based on an assumption of reaction with dry gaseous oxygen in the atmosphere. However, under a high humidity environment, there is a problem that boric oxide of the glass element becomes boric acid, which in turn melts on the fuse element, thereby corroding the fuse element pattern of Cu. Additionally, because the fuse element pattern is formed by Cu on its surface, movement of Cu is promoted when exposed to a high temperature environment, which may result in upheaval of Cu along a grain boundary. Thus there is a possibility that the fuse element may be damaged by long term use in a high humidity and/or high temperature environment.

SUMMARY OF INVENTION

Technical Problem

The current invention has been made based on the above-mentioned circumstances. Therefore an object of the invention is to provide a chip type fuse excellent in resistance to climate conditions, whereby the fuse is able to operate stably under high temperature and high humidity environments.

Solution to Problem

The chip type fuse of the invention includes an insulative substrate; an under-glass layer formed on the insulative substrate; a fuse element formed on the under-glass layer; a pair of electrodes formed at both end sides of the fuse element; and an over-glass layer covering at least a fusing section of the fuse element; wherein the fuse element includes a layer where a first metal layer and a second metal layer are piled up, and a barrier layer consisting of a third metal layer, which covers the first metal layer and the second metal layer with a width that is wider than the width of the first metal layer and the second metal layer.

Though, there was a problem that over-glass layer includes borosilicate glass that contains boron for lowering melting point, boric oxide of the glass layer becomes boric acid in high temperature and high humidity environments, and it begins to melt on the fuse element, and corrode the fuse element pattern of Cu etc. According to the invention, because the chip type fuse includes a barrier layer consisting of a third metal layer, which covers the fuse element pattern, thereby the fuse element pattern can be prevented from being corroded.

Further, though a metal layer of the Cu, etc. excellent in conductivity tends to become fluid in the fuse element in a high temperature environment, the barrier layer can control this movement, thus resistance to heat can be improved. Therefore, the chip type fuse excellent in resistance to climatic conditions, which operates stably in high temperature and high humidity environments, can be obtained.

BRIEF DESCRIPTION OF DRAWINGS

FIG. 1 is a cross-sectional view of the chip type fuse of an embodiment of the invention along AA lines in FIG. 2 and FIG. 3.

FIG. 2 is a plan view of the chip type fuse of FIG. 1 after forming the over-glass layer.

FIG. 3 is a plan view of the chip type fuse of FIG. 1 after forming protective resin layer.

FIG. 4 is an enlarged cross-sectional view of the chip type fuse along BB lines in FIG. 2 and FIG. 3.

FIG. 5 is a graph showing a result of 85° C./85% humidity/power on testing performed on chip type fuses and a prior art structure.

FIG. 6 is a graph showing a result of 175° C. resistance to heat storage testing performed on chip type fuses and a prior art structure.

FIG. 7 is a graph showing a result of 134° C./95% humidity and power on testing performed on chip type fuses and a prior art structure.

DESCRIPTION OF EMBODIMENTS

Embodiments of the invention will be described below referring to FIG. 1 through FIG. 7. Like or corresponding parts or elements will be denoted and explained by same reference characters throughout views.

FIGS. 1-4 show a structure of the chip type fuse of an embodiment of the invention. The fuse 10 includes an insulative substrate 11, such as alumina etc., an under-glass layer 12 formed on the substrate, a pair of electrodes 15A formed on both end sides of the under-glass layer at least a portion of the electrodes piled up on the under-glass layer, a fuse element 15 formed between the end face electrodes 13, and an over-glass layer 17 covering at least a fusing section 15B of the fuse element 15. The fuse element 15 consisting of wide-width electrode sections 15A and narrow-width fusing section 15B connecting to the electrode sections 15A is integrally formed. The under-glass layer 12 is formed below the fusing section 15B of the fuse element 15.

The fuse element 15 consists of first metal layer 15*a* formed by sputtering and second metal layer 15*b* also formed by sputtering piled up on the layer 15*a*. First metal layer 15*a* consists of a Cr layer having a film thickness of, for instance, about 500 Å, and second metal layer 15*b* consists of a Cu layer having a film thickness of, for instance, about 1-3 μm. Here, the current flows mainly through the second metal layer consisting of the Cu layer of higher conductivity. And, the first metal layer 15*a* mainly plays the role to connect the second metal layer 15*b* on the under-glass layer 12.

The fuse element layer 15 includes a barrier layer 16 consisting of the third metal layer, which covers the first metal layer 15*a* and the second metal layer 15*b* with width that is wider than the width of the first metal layer 15*a* and the second metal layer 15*b*. That is, the barrier layer 16 consisting of the third metal layer overwraps the second metal layer 15*b* and the first metal layer 15*a* (see FIG. 4). In this embodiment, the fuse element 15 includes the first metal layer 15*a*, the second metal layer 15*b*, and the barrier metal layer 16. The third metal layer as the barrier layer 16 preferably consists of Ta or Cr, and is formed by sputtering. However, Ni, NiCr(6:4), NiCr(8:2), or Ti, etc. demonstrates a barrier effect, and can be used as the barrier layer. It is preferable that the film thickness of the barrier layer 16 is in range of 50-2000 Å.

Over-glass layer 17, has a width narrower than a width of electrode section 15A, and is formed at an area for covering the fusing section (fuse element) 15B of the fuse element 15. Accordingly four surfaces of the second metal layer 15*b* consisting of Cu, which becomes the main current route, are surrounded by barrier layer 16 consisting of Ta or Cr etc. and first metal layer 15*a* consisting of Cr. Further, the fuse element 15 consisting of first and second metal layers and the barrier layer 16 consisting of third metal layer are surrounded by under-glass layer 12 and over-glass layer 17 (see FIG. 4).

The protection layer 18 consisting of epoxy resin etc. is disposed at an upper side of the over-glass layer 17. The end face electrodes 13 connecting front electrode 15A and rear electrode 14 is formed at end face of insulative substrate 11. The plated electrode layers 20*a*, 20*b*, 20*c*, 20*d*, which are suitable for surface mounting, are formed on exposed surfaces of end face electrodes and front and rear electrodes 13, 15A, 14 (see FIG. 1 and FIG. 2). Plated electrode layer 20*a* consists of Ni plated layer, plated electrode layer 20*b* consists of Cu plated layer, plated electrode layer 20*c* consists of Ni plated layer, and plated electrode layer 20*d* consists of Sn plated layer. Such a structure is similar to usual chip type parts, thus the chip type fuse 10 comprises such chip type parts, and thereby is available for surface mounting.

Low melting point glass is used for over-glass layer 17, because of the restriction that the later processes must be performed at a lower temperature. In general, the low melting point glass contains components such as boron, lead, or bismuth etc. for lowering the melting point. One of these typical components is a borosilicate glass. The borosilicate glass takes moisture in under a humidity environment. The following reactions take place for producing boric acid (H3BO3), which corrodes Cu. Then the fuse element consisting of Cu corrodes under the high humidity environment.

$$B_2O_3(\text{glass})+3H_2O \rightarrow 2H_3BO_3(\text{boric acid})$$

$$CuO+2H_3BO_3(\text{boric acid}) \rightarrow Cu(BO_2)_2+3H_2O$$

That is, in the high humidity environment, an outside water molecule (moisture) enters into the product and when it reaches the fuse element, the fuse element corrodes by the oxidation action between moisture and boron components. Such a mechanism can be assumed. Therefore, because barrier layer 16 guards against the interaction of water molecules with Cu in the fuse element layer 15, corrosion by moisture intrusion to Cu is prevented and resistance to humidity can be improved.

Further, in the high temperature environment, Cu particles in the fuse element 15 are activated by the thermal energy, and thereby become more fluid. Accordingly, because Cu particles on a surface of the fuse element tend to cause a transfer phenomenon, the barrier layer 16 is formed so as to cap the surface and to stop movement of Cu particles on the fuse element. Therefore, because of the barrier layer 16, the transfer phenomenon etc. of Cu is prevented, and resistance to heat can be improved. As a result, because the barrier layer 16 can be effective to two kinds of failure mechanisms, the barrier layer 16 can improve resistance to humidity and resistance to high temperature, and an excellent chip type fuse resistant to climatic conditions is obtained.

FIG. 5 shows a result of 85° C. temperature/85% humidity/power on test. The test was carried out on samples including the barrier layer 16 and a prior art structure. As a result, in the case of the barrier layer 16 being Ta or Cr, domination of resistance to climatic conditions has been confirmed to the prior art structure (no barrier layer). That is, samples were extracted after the test, and whether corrosion of fuse element layer 15 had been caused or not was confirmed. As a result, it was confirmed in the case of the barrier layer 16 being Ta or Cr that no significant corrosion occurred compared to the prior art structure (no barrier layer). However, there are certain materials which are not effective to prevent corrosion.

In the case of carrying out the resistance to climatic condition test, the prior art structure (no barrier layer), had corrosion portions on the fuse element as a result. However, the barrier layer 16 consisting of Ta or Cr (both thickness: 250 Å), did not have corrosion as a result and change in the resistance value was minor, t thereby confirming the effect of the barrier layer. Further, a barrier layer 16 consisting of Ni (thickness: 333 Å) did not exhibit corrosion, confirming the effect of such a barrier layer. Also, when a barrier layer 16 consisting of Ni, NiCr(6:4), NiCr(8:2), or Ti, is utilized, the results indicate that resistance to humidity improves.

On the other hand, when the barrier layer 16 consists of Cr, or Ta, it is more effective for preventing the particle movement phenomenon on the Cu surface under a high temperature environment. By forming barrier layer 16 consisting of Cr or Ta (both 250 Å) on a surface of the fuse element layer 15 consisting of Cu, the activity of Cu particles in the fuse element layer can be decreased, and thereby long-term operation characteristic can be improved.

In order to confirm the above, five kinds of samples (a prior art structure and barrier layer structures, with the following characteristics, Ni (66 Å), Ni (333 Å), Ta(250 Å), and Cr(250 Å)) were made. And, the samples were left in a 175° C. environmental chamber, and ΔR (resistance change) was observed (see FIG. 6). After 1000 hours passed, the prior art structure (no barrier layer), exhibited a resistance change substantially larger (Max.=5.5%) that the samples having a barrier layer structure.

The best material for the barrier layer was Cr, which demonstrated a small resistance change (Max.=1.11%). The Ta sample demonstrated similar results. The samples were extracted and the fuse elements were observed. As to the barrier layer structure of the above materials, particle movement phenomenon on the Cu surface was not found. From the above testing, the effect of improving resistance at high temperature by including the barrier layer structure has been confirmed.

FIG. 7 shows the result of a PCT test. The PCT test is an abbreviation of "pressure", "cooker", "test", and is a simulated accelerated life test. It is a severe test that impresses 8% of ratings current under a temperature of 134° C. in a pressurized steam atmosphere of 95% humidity. As a result, by extremely increasing the pressure of water vapor inside of the test chamber simulation of infiltration of moisture into a device can be performed in a shortened time.

As to resistance change (ΔR) after 50 hours or more passed, the barrier layer Cr750 Å sample (●mark) and barrier layer Ti1500 Å sample demonstrated the least resistance change, Next, the barrier layer Ta750 Å sample (♦mark) demonstrated a slightly greater change. The barrier layer Ni1500 Å(■mark) sample demonstrated a greater resistance change than the above samples, and the barrier layer Ni750 Å sample demonstrates a slightly greater change than the Ni1500 Å sample. However, the resistance change (ΔR) of any sample having a barrier layer was less than that of the prior art structure (no barrier layer).

As demonstrated above, by including the barrier layer, resistance to climatic conditions on the chip type fuse can be improved, and a thin film such as Cr, Ta, or Ti etc. is especially effective as the barrier layer. Moreover, Ni, NiCr (6:4), and NiCr(8:2), etc. were studied. The movement of Cu particles is not observed upon these devices. And, it is thought that resistance change (ΔR) of these materials is less than that of a prior art structure as shown in FIG. 7, and these materials are also effective as the barrier layer.

Although embodiments of the invention are explained above, the invention is not limited to the above embodiments, and various changes and modifications may be made within the scope of the technical concepts of the invention.

INDUSTRIAL APPLICABILITY

The invention can be suitably used for chip type circuit protection elements, especially for chip type fuses.

The invention claimed is:

1. A chip type fuse, comprising:

an insulative substrate;

an under-glass layer formed on the insulative substrate;

a fuse element formed on the under-glass layer;

a pair of electrodes formed at both end sides of the fuse element; and an over-glass layer covering at least a fusing section of the fuse element;

wherein the fuse element includes a layer where a first metal layer and a second metal layer are piled up, and a barrier layer consisting of a third metal layer, which covers the first metal layer and the second metal layer with width that is wider than the width of the first metal layer and the second metal layer, and wherein the second metal layer consisting of Cu, which becomes main current route, is surrounded by the barrier layer consisting of any one of Ta, Cr, Ni, NiCr, or Ti and the first metal layer consisting of Cr.

2. The chip type fuse of claim 1, wherein the second metal layer is positioned between the first metal layer and the third metal layer.

3. The chip type fuse of claim 1, wherein thickness of the barrier layer is in the range of 50-2000 Å.

* * * * *